US005640860A

United States Patent [19]

Carter et al.

[11] Patent Number: 5,640,860

[45] Date of Patent: Jun. 24, 1997

[54] TAMPER RESISTANT COMBINATION LOCK

[76] Inventors: Robert L. Carter, 3124 Brossman St., Naperville, Ill. 60564; George W. Carter, Jr., 5300 Walnut, Colleyville, Tex. 76034

[21] Appl. No.: 584,459

[22] Filed: Jan. 11, 1996

[51] Int. Cl.[6] ..... E05B 37/16

[52] U.S. Cl. ..... 70/25; 70/68; 70/23

[58] Field of Search ..... 70/25, DIG. 80, 70/64, 68, 23, 26

[56] References Cited

U.S. PATENT DOCUMENTS

| | | | |
|---|---|---|---|
| 603,711 | 5/1898 | Snyder | 70/25 |
| 1,387,750 | 8/1921 | Appleton | 70/25 |
| 1,401,030 | 12/1921 | Ashkar | 70/25 |
| 1,503,043 | 7/1924 | Greer | 70/25 |
| 1,686,632 | 10/1928 | Mayer | 70/25 |
| 1,759,283 | 5/1930 | Schmidt | 70/68 |
| 2,101,264 | 12/1937 | Mayer | 70/25 |
| 2,985,005 | 5/1961 | Kahn | 70/25 |
| 3,580,016 | 5/1971 | Kerr | 70/68 |
| 4,862,714 | 9/1989 | Taylor et al. | 70/25 |
| 4,866,958 | 9/1989 | Bretl et al. | 70/25 |
| 4,952,228 | 8/1990 | Taylor et al. | 70/25 |
| 4,959,978 | 10/1990 | Cappell et al. | 70/25 |

FOREIGN PATENT DOCUMENTS

| | | | |
|---|---|---|---|
| 26694 | 9/1920 | Denmark | 70/25 |
| 5160059 | 12/1920 | France | 70/25 |

*Primary Examiner*—Steven N. Meyers
*Assistant Examiner*—Donald J. Lecher

[57] ABSTRACT

A tamper resistant combination lock including a housing having a through bore receiving a locking plunger with a plurality of integral spaced obstructions thereon, the housing having a plurality of transverse slots each receiving one of two identical blocking slides that snap between three distinct positions, one passing the obstructions and plunger, and two blocking the obstructions and plunger. Lock picking is minimized by flexible fingers in the slides that engage the plunger obstructions when the slides are in the plunger passing position to simulate the slide blocking positions as the lock picker tugs the plunger.

14 Claims, 4 Drawing Sheets

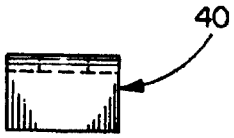
Fig. 14
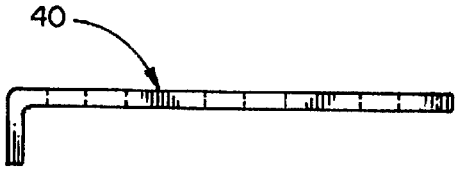
Fig. 15
Fig. 16
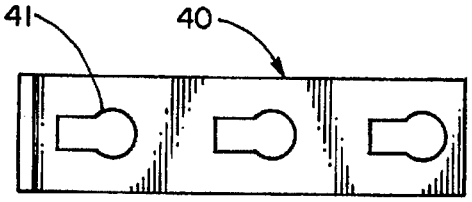
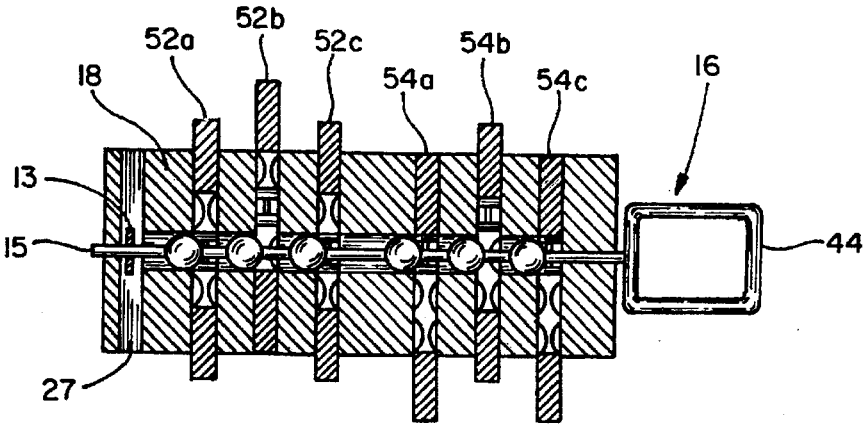
Fig. 17
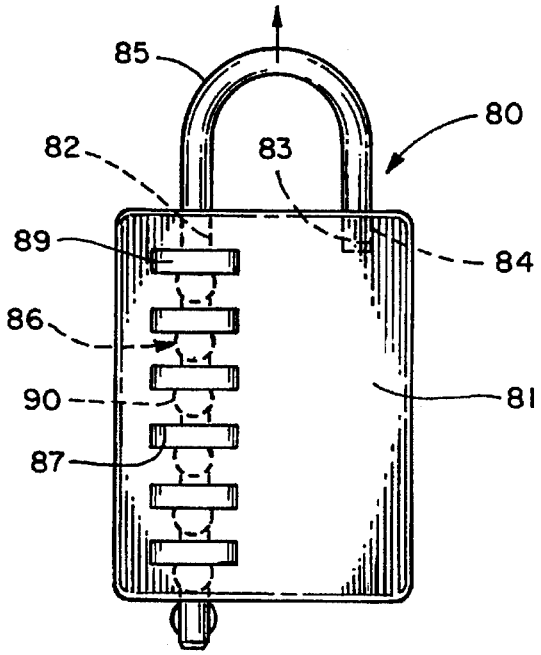
Fig. 18

TAMPER RESISTANT COMBINATION LOCK

BACKGROUND OF THE INVENTION

Combination locks have, of course, achieved considerable commercial success, but attempts to manufacture and market relatively inexpensive locks have been quite difficult largely because very inexpensive locks are fairly simple to pick. While the present lock is exemplified as an aftermarket combination lock for pistol cases, the lock has other low costs applications, and hence, the prior art is equally as broad.

A preliminary patentability search resulted in the following collection of United States Patents: Enholm, U.S. Pat. No. 428,387; Battershell, U.S. Pat. No. 1,733,772; Legat, U.S. Pat. No. 2,898,974; Ponder, U.S. Pat. No. 2,740,530; Nemsky, U.S. Pat. No. 3,155,230; Esquibel, et al., U.S. Pat. No. 3,514,981; Feinberg, U.S. Pat. No. 3,597,945; Pedro, U.S. Pat. No. 3,865,166, Jones, Re. U.S. Pat. No. 30,139; Ippolito, et al., U.S. Pat. No. 4,187,703; Gordon, U.S. Pat. No. 4,463,847; Terada, et al., U.S. Pat. No. 5,081,855; Jarboe, U.S. Pat. No. 5,125,661; and Blanchard, U.S. 5,322,200.

The Ippolito, et al., U.S. Pat. No. 4,187,703 shows a locking system applied to an envelope defined by a pair of spaced plates, holding a numismatic coin. The Ippolito device has a slide plate 14 with cross slots 16 transversely positioned away from a central longitudinal slot 18. The transversely movable slides are all identical and can be positioned either in a right-hand or left-hand orientation as seen in FIG. 9. This arrangement, however, produces only two positions for each switch and, therefore, yields few combinations.

The Jarboe, U.S. Pat. No. 5,125,661, discloses a plunger-type locking mechanism, but there is really no logic in the lock combination because if all the plungers are depressed, the plunger 19 can be removed regardless of the position of blocks 35. Thus, it is not really a true combination lock at all.

The Esquibel, et al., U.S. Pat. No. 3,514,981, discloses a plunger-type locking mechanism for a box wherein a locking bar 14 is held or released by a plurality of slide bars 13 that have second slots 30 all positioned the same distance from the inner ends of the bars, and first slots 29 positioned in varying locations to correspond to one of the indicia on area 33 of the projecting ends of the bars 13. When the bars are slid to the appropriate indicia, the slots 29 permit the release of bars 14. The Equibel, et al. lock has a total of only 48 combinations possible with five bars 13.

It is a primary objection of the present invention to ameliorate the problems noted in the prior art above and provide a low cost combination lock that is considerably more tamper-proof than prior art constructions while at the same time having a greater number of possible combinations.

SUMMARY OF THE PRESENT INVENTION

According to the present invention, a low cost tamper resistant combination lock is provided that combines a high number of possible combinations with improved tamper resistance. Toward this end, the present lock includes a one piece molded plastic housing having a through bore that receives a one piece plastic plunger having a plurality of integral spherical obstructions. The housing has a plurality of transverse slots each receiving one of two identical blocking slides that snap between three distinct positions, one passing the spherical obstructions and two blocking the obstructions and plunger. Lock picking is minimized by integral flexible fingers in obstruction passing apertures in the slides that engage the spherical obstructions when the slides are in the plunger passing position to simulate the slide blocking positions as the lock picker tugs the plunger.

In the exemplary embodiment disclosed in this application, the housing has a plurality of rivet head shaped bottom projections that can pass through apertures in a flexible pistol case enabling the lock to be used to engage and lock the zipper tang of the case in its zipper closed position.

It should be understood, however, that the present tamper resistant lock can be utilized in other applications because of its low cost and tamper resistance.

The first of the two blocking slides is rectangular in configuration and has a central through bore that has a diameter slightly larger than the plunger's spherical obstructions and side slots extending laterally from the central aperture that receive the small diameter portions of the plunger between the spherical obstructions when this slide is in its two blocking positions on either side of the central aperture. Both sides of this blocking slide have side recesses aligned with the ends of the slot that receive the spherical plunger projections when in the blocking positions providing a snap action movement of the blocking slide between its three positions.

This snap action not only facilitates the use of the blocking slides but also improves tamper resistance because the lock picker feels the same snap action when moving from the blocking position to the pass position or from the pass position to one of the blocking positions.

To further enhance tamper resistance, a plurality of integral tabs or spring fingers are formed in the central passing aperture in the slides, and they engage the spherical obstructions when the slide is in the passing position. Thus, if the lock picker tugs on the plunger when the slide is in its passing position(but still blocked by other blocking slides), the spherical obstruction will hit the spring fingers causing that particular slide to shift slightly in the slot in a longitudinal direction the same as the slides do when in the blocking position. In this way the lock picker cannot distinguish between the slight shifting movement of the slides in the blocking position and the slides in the passing position when he tugs longitudinally on the plunger.

The second blocking slide is similar to the first except that the passing aperture is in the side position and the slot is a lateral slot extending from the aperture through the central position to the opposite side position. This slide has the same spherical receiving recesses as the first blocking slide formed on both surfaces. This second slide can be reversed in the housing slots to provide both left-hand and right-hand passing thereby increasing the possible combinations without any additional cost.

Since the housing, the blocking slides and the plunger are all one piece plastic moldings, the resulting combination lock is quite inexpensive to manufacture.

Other objects and advantages of the present invention will appear more clearly from the following detailed description of the preferred embodiment.

BRIEF DESCRIPTION OF THE DRAWINGS

FIG. 14 is an end view of the L-shaped housing slide connector;

FIG. 15 is a side view of the connector illustrated in FIG. 14;

FIG. 16 is a bottom view of the connector illustrated in FIGS. 14 and 15;

FIG. 17 is a longitudinal section of the present tamper resistant lock with all six blocking slides shown in various positions, and;

FIG. 18 is an alternative form of the present tamper resistant lock shown and exemplified in a padlock-type lock.

DETAILED DESCRIPTION OF THE PREFERRED EMBODIMENT

Figure 1:
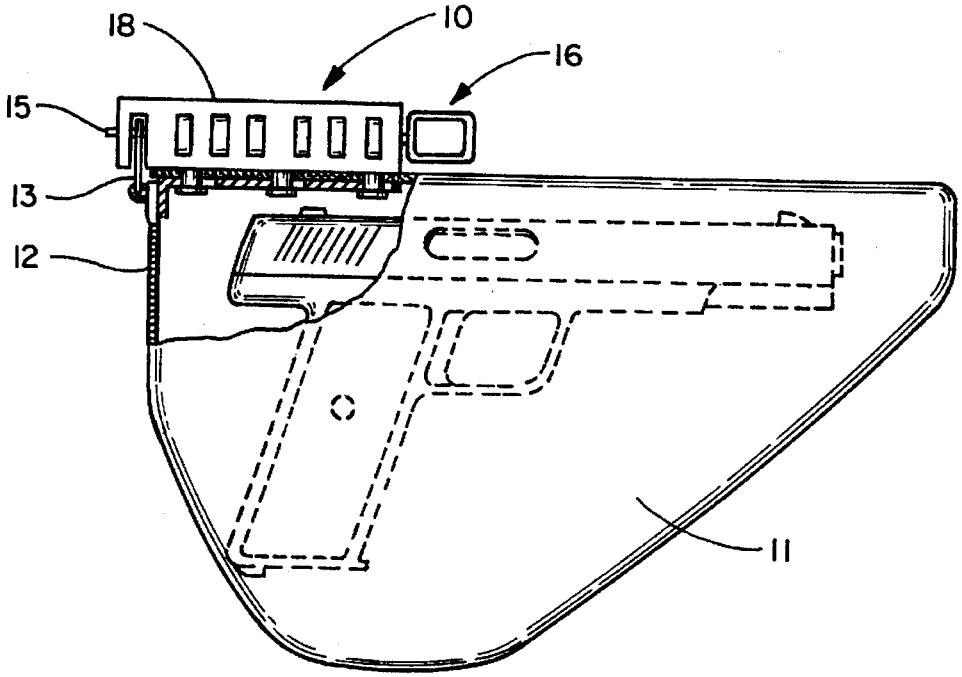
FIG. 1 is a side view of a flexible pistol case with the present tamper resistant combination lock fastened to its upper surface holding its zipper tang in a locked position with part of the fabric broken away near the lock mounting.
Figure 2:
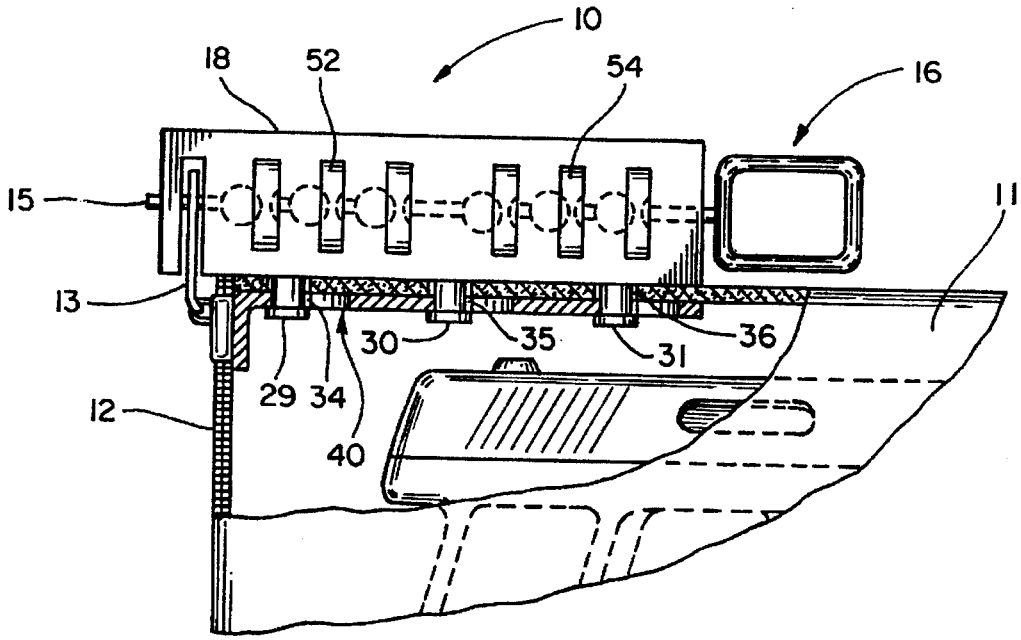
FIG. 2 is an enlarged fragmentary view of FIG. 1 showing the present tamper resistant combination lock and illustrating its manner of connection to the pistol case.

Referring to the drawings and particularly FIGS. 1 and 2, the present tamper resistant combination lock assembly 10 is illustrated attached to a flexible pistol case 11 having a peripheral zipper 12 and a pivotal zipper tang 13 having a conventional aperture there-through held in a locked position by distal end 15 of a locking plunger 16 forming part of the combination lock 10.

As seen in FIGS. 3, 4 and 11 to 13, the lock housing 18 is seen to be generally rectangular in configuration and may be constructed of a one piece plastic molding. A central bore 20 extends longitudinally through the housing and it is intersected by six blocking slide receiving transverse slots 21, 22, 23, 24, 25 and 26. Note the configuration of the slots and bore shown in fragmentary form in FIG. 4. An additional end slot 27 is provided for receiving zipper tang 13.

Figure 11:
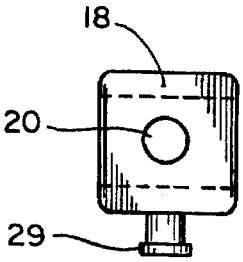
FIG. 11 is an end view of the lock housing.
Figure 12:
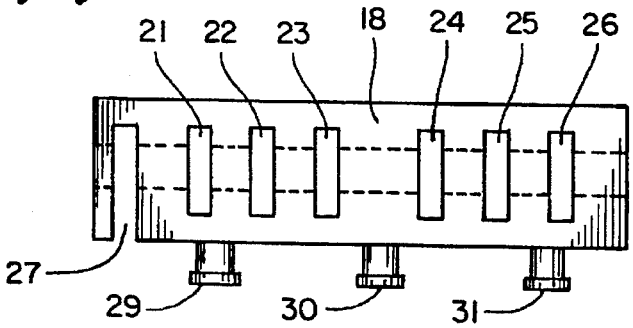
FIG. 12 is a side view of the lock housing.
Figure 13:
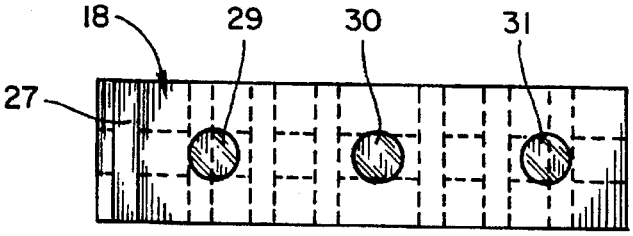
FIG. 13 is a bottom view of the lock housing.

As seen in FIGS. 11 and 12, the housing has three integral headed projections 29, 30, 31 extending downwardly therefrom that are designed to pass through apertures 34, 35 and 36 in the top wall of the pistol case 11. A key-hole type L-shaped connector 40 illustrated clearly in FIGS. 14, 15 and 16 has three key-hole type apertures 41 that receive the headed projections 29, 30 and 31 to lock the housing 18 and the lock 10 to the pistol case 11 in its appropriate position.

Figure 9:
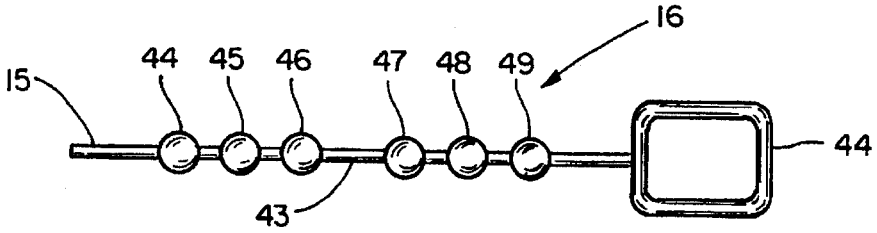
FIG. 9 is a sub-assembly view of the locking plunger.
Figure 10:
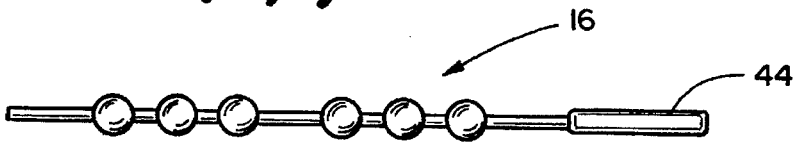
FIG. 10 is an orthogonally rotated view of the locking plunger illustrated in FIG. 9.

As seen in FIGS. 9 and 10, plunger 16, which can be easily constructed of a one piece plastic molding, includes a rod portion 43 having a finger loop 44 at one end and six integral spherical obstructions 44, 45, 46, 47, 48 and 49.

Figure 3:
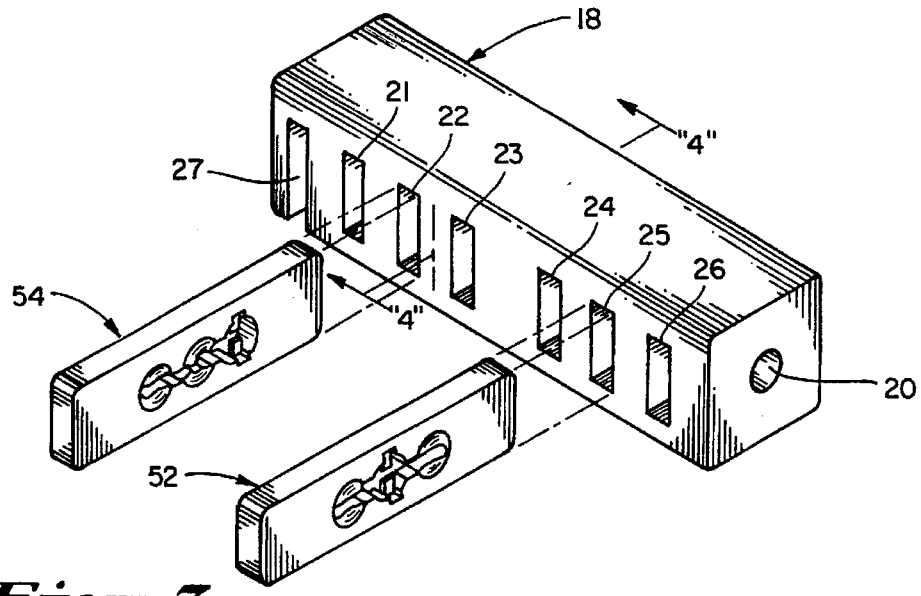
FIG. 3 is an exploded perspective illustrating the one piece lock housing with one of each of the two standard blocking slides.
Figure 4:
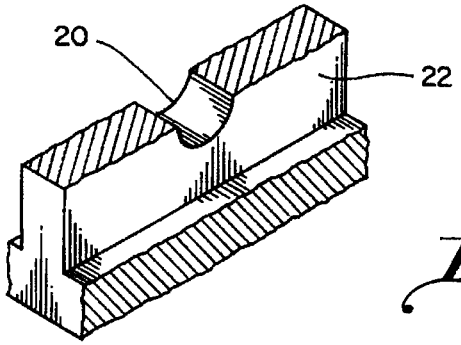
FIG. 4 is a fragmentary section of the housing taken generally along line 4—4 of FIG. 3.
Figure 5:
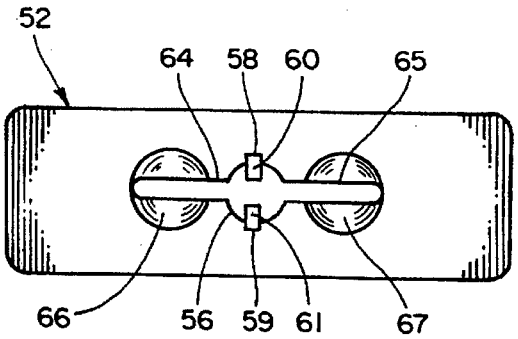
FIG. 5 is a side view of one of the standard blocking slides.
Figure 6:
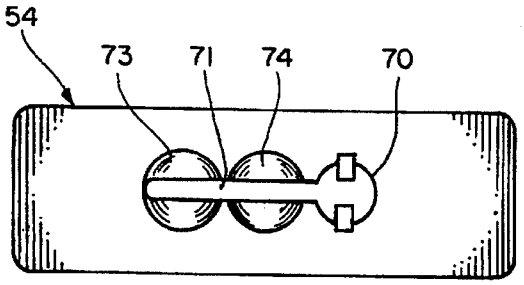
FIG. 6 is a side view of the other standard blocking slide.

Two standard blocking slides 52 and 54 are illustrated respectively in FIGS. 5 and 6(as well as FIG. 3). It should be understood that of the six slides in the exemplary embodiment illustrated, three take the form of slide 52 and three take the form of slide 54.

It should be understood as seen in FIGS. 3, 5 and 6, that the slides 52 and 54 are rectangular in configuration and identically configured on both sides of each so that the slides 52, 54 are reversible in slots 21 to 26.

Figure 7:
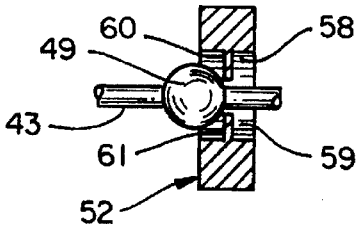
FIG. 7 is a cross section through one of the blocking slides taken through the passing aperture showing the spring finger positions.
Figure 8:
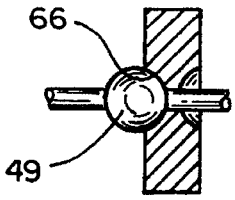
FIG. 8 is a cross section through the blocking slide in one of the blocking positions.

Each of the slides is a one piece rectangular plastic molding, and slide 52 includes a central through aperture 56 having a diameter slightly larger than spherical obstructions 44 to 49. Aperture 56 has upper and lower key-type slots 58 and 59 that have molded therein integral spring fingers 60 and 61 shown also in FIG. 7. The spherical projection 49 in FIG. 7 is illustrated in the lock position of the plunger, and in this position the spring fingers 60 and 61 engage one side of the obstruction 49. As a would-be lock picker pulls outwardly on plunger loop 44, obstruction 49, because of its engagement with spring fingers 60 and 61 shifts the slide very slightly laterally in its slot the same way the obstruction would shift the slide when in its blocking position illustrated in FIG. 8. In this way, regardless of whether the slide is in its blocking position or in its passing position, when the plunger is pulled axially each of the slides will shift in their respective slots making it impossible for the lock picker to distinguish between slides in the locking position and slides in the blocking position.

However, fingers 60 and 61 are sufficiently flexible so they fold down in their adjacent recesses when plunger 16 is pulled with all the slides in the obstruction passing position, permitting the distal end 15 of the plunger to release tang 13.

Returning to FIG. 5, slide 52 has a pair of transverse slots 64 and 65 having a height somewhat greater than the rod portions 43 of the plunger that receive the rod portion in the two blocking positions of slide 52. The slide 52 has side recesses 66 and 67 at the ends of the slot(on both sides of the slides) that receive the spherical plunger projections when the slide is in its blocking position(see FIGS. 8 and 17 for exemplary illustrations of the spherical projections when in the blocking recesses).

The blocking slide 54 has the same outer geometry as the slide 52 but rather than a central aperture has a side aperture 70 that passes projections 44 to 49 and a lateral slot 71 that passes plunger portion 43 and extends through the central position of the slide and the other side position. Recesses 73 and 74 are provided on both sides of the slide aligned with the two blocking positions of the slide and are identical in geometry to recesses 66 and 67 in slide 52.

Because both sides of slide 54 are identical, this slide can be reversed in the slots 21 to 26 to effect either right side blocking or left side blocking as desired thereby increasing the possible combinations of the lock without requiring the tooling for a third slide.

As seen in FIG. 17, plunger 44 is in its locked position and in this position the spherical projections 44 to 49 are either partly in one of the passing apertures 56 in slides 52 or 70 in slides 54, or in one of the blocking recesses 66, 67, 73, 74. The position of the loop 44 close to housing 18 holds the spherical projections 44 to 49 in either the blocking recesses or through apertures in the slides. However, there is still a small amount of play there-between.

In use, and in reference particular to FIG. 17, assume that each of the blocking sides 52*a*, 52*b*, 52*c*, 54*a*, 54*b*, and 54*c* are in their plunger passing positions and that plunger 16 is partly withdrawn with its distal end 15 short of end slot 27.

Gun case zipper 12 is then closed and its tang 13 positioned as shown, then plunger 44 is shifted to the left impaling the aperture in the zipper tang and moving the plunger to its locking position illustrated in FIG. 17.

Slides 52 and 54 are then all shifted away from the passing positions to one of the two blocking positions of each. Unlocking is, of course, effected by shifting each of the slides from one's memory or notes to its passing position. Because each of the blocking slides has only three positions and these positions are distinct, it is relatively easy to memorize the lock combination and also relatively easy for the lock user to unlock the lock from memory simply by "feeling" the position of the slides even in the dark.

The lock combination can be changed by either switching one or more slides 52 with one or more slides 54 or by rotating one or more slides 54 180 degrees in its slot as noted above.

FIG. 18 illustrates an alternative form of the present invention and is exemplified as a combination padlock, and is seen to include a rectangular padlock housing 80 having a main bore 82 there-through and a secondary bore 83 extending partly there-through that receives a distal end 84 of a U-shaped portion 85 of plunger 86. The housing 81 has a plurality of transverse slots 87 there-through that receive a plurality of blocking slides 89 that effect selective blocking of spherical obstructions 90 formed on the plunger 86.

The portion of the plunger 86 slidable in main passage 82 is identical to the corresponding portion of plunger 16 in the FIGS. 1 to 17 embodiment and blocking slides 89 are identical to blocking slides 52 and 54 also illustrated with respect to the FIG. 17 embodiment. The plunger 86 and U-shaped portion 85 are rotatable in housing main passage 82 to effect the desired swiveling motion in a padlock and, of course, the symmetrical shape of the plunger portion in bore 82 and the spheroidal configuration of obstructions 90 conveniently accommodate the desired pivotal, as well as reciprocal, motion of U-shaped plunger portion 85 as distal end 84 moves in and out of secondary passage 83 and swivels toward and away from the lock body 81.

We claim:

1. A tamper resistant combination lock for a container, comprising: a lock housing having a main passage there-through intersected by a plurality of cross slots, a plunger slidable in the main passage having a plurality of obstructions thereon, a plurality of generally planar blocking slides reciprocal in the cross slots having aperture means generally centrally therethrough receiving the plunger movable to at least two indexible positions relative to the plunger, one in which the plunger obstructions are blocked by slides substantially entirely around the aperture means and one in which the plunger obstructions may pass through the aperture means, said indexible positions being defined by cooperating means on the slides including the aperture means and the plunger obstructions that provide a snap action movement as the slides are moved from one indexible position to the next, said plunger being movable through the block slides in a direction perpendicular to the block slides, and means to minimize lock picking including means on the slides engageable with the plunger obstructions when the slides are in the obstructions pass position that cause the slides to shift slightly in the housing slots as the plunger is tugged by the lock picker.

2. A tamper resistant combination lock for a container, comprising; a lock housing having a main passage there-through intersected by a plurality of cross slots, a plunger slidable in the main passage having a plurality of obstructions thereon, a plurality of blocking slides reciprocal in the cross slots movable to at least two indexible positions relative to the plunger, one in which the plunger obstructions are blocked and one in which the plunger obstructions may pass, said indexible positions being defined by cooperating means in the slides and the plunger obstructions that provide a snap action movement as the slides are moved from one indexible position to the next, and means to minimize lock picking including means on the slides engageable with the plunger obstructions when the slides are in the obstructions pass position that cause the slides to shift slightly in the housing slots as the plunger is tugged by the lock picker, the slides having apertures there-through that define the plunger obstructions pass position, at least one finger in the slide apertures engageable with the obstructions when the slides are in the plunger obstructions pass position defining the means to minimize lock picking.

3. A tamper resistant combination lock as defined in claim 1, wherein the slides have at least three indexible positions relative to the plunger, one in which the plunger may pass and two in which the plunger is blocked.

4. A tamper resistant combination lock as defined in claim 3, wherein the slides are standardized into two configurations including a first plurality of identical slides having a central aperture that passes the obstructions and two side apertures that block the obstructions, and a second plurality of identical slides having a side aperture that passes the obstructions and central and other side apertures that block the plunger obstructions.

5. A tamper resistant combination lock as defined in claim 4, wherein said second plurality of slides are each reversible in the housing slots to effect three passing positions of the slides with only two standard slides.

6. A tamper resistant combination lock for a container, comprising; a lock housing having a main passage there-through intersected by a plurality of cross slots, a plunger slidable in the main passage having a plurality of obstructions thereon, a plurality of blocking slides reciprocal in the cross slots movable to at least two indexible positions relative to the plunger, one in which the plunger obstructions are blocked and one in which the plunger obstructions may pass, said indexible positions being defined by cooperating means on the slides and the plunger obstructions that provide a snap action movement as the slides are moved from one indexible position to the next, each slide having an aperture there-through that passes the plunger obstructions and a slot extending from the aperture that receives portions of the plunger between the plunger obstructions, said slides having a recess that receives a portion of the obstructions in the slide blocking position that provide the snap action movement of the slides as they are moved between the plunger blocking and plunger passing positions.

7. A tamper resistant combination lock for a container, comprising; a lock housing having a main passage there-through intersected by a plurality of cross slots, a plunger slidable in the main passage having a plurality of obstructions thereon, a plurality of blocking slides reciprocal in the cross slots movable to at least two indexible positions relative to the plunger, one in which the plunger obstructions are blocked and one in which the plunger obstructions may pass, said indexible positions being defined by cooperating means on the slides and the plunger obstructions that provide a snap action movement as the slides are moved from one indexible position to the next, the slides having at least three indexible positions relative to the plunger, one in which the plunger may pass and two in the plunger is blocked, the slides are standardized into two configurations including a first plurality of identical slides having a central aperture that passes the obstructions and two side apertures that block the obstructions, and a second plurality of identical slides having a side aperture that passes the obstructions and central and other side apertures that block the plunger obstructions, said second plurality of slides are each reversible in the housing slots to effect three passing positions of the slides with only two standard slides, the side apertures in the first slide being defined by slots extending transversely from the passing aperture, said slides each having two recesses therein that receive a portion of the plunger obstructions in the two blocking positions that provide the snap action movement of the slides as they are moved between the plunger blocking and passing positions.

8. A tamper resistant combination lock for a container, comprising; a lock housing having a main passage there-through intersected by a plurality of cross slots, a plunger slidable in the main passage having a plurality of obstructions therein, a plurality of blocking slides reciprocal in the cross slots movable to at least two indexible positions relative to the plunger, one in which the plunger obstructions are blocked and one in which the plunger obstructions may pass, said indexible positions being defined by cooperating means on the slides and the plunger obstructions that provide a snap action as the slides are moved from one indexible position to the next, means to minimize lock picking including means on the slides engageable with the plunger obstructions when the slides are in the obstruction pass position that cause the slides to shift slightly in the housing slots as the plunger is tugged by the lock picker, said slides having apertures there-through that define the plunger obstruction pass position, at least one finger in the slide apertures engageable with the obstructions when the slides are in the plunger obstructions pass position defining the means to minimize lock picking, said slides having at least three indexible positions relative to the plunger, one in which the plunger may pass and two in which the plunger is blocked, said slides being standardized into two configurations including a first plurality of identical slides having a central aperture that passes the obstructions and two side apertures that block the obstructions, and a second plurality of identical slides having a side aperture that passes the obstructions and central and side apertures that block the plunger obstructions.

9. A tamper resistant combination lock for a container, comprising: a one piece lock housing having a main passage there-through intersected by a plurality of cross slots, a plunger slidable in the main passage having a plurality of obstructions therein, a plurality of generally planar blocking slides reciprocal in the cross slots movable to at least three positions relative to the plunger having apertures means there-through receiving the plunger, two in which the slides around the aperture means block the plunger obstructions and one in which the slides and aperture means do not block the plunger obstructions, said plunger being movable in a direction perpendicular to the blocking slides, said slides being standardized including a first plurality of slides in which the aperture means includes a central aperture there-through permitting the passage of the obstructions there-through and side apertures there-through that block the, obstructions and a second plurality of slides having a side aperture therethrough permitting the passage of the obstructions therethrough and a central aperture and a side aperture therethrough that block the plunger obstructions, whereby the possible lock combinations are increased, and means to minimize lock picking including means in the slides engageable with the plunger obstructions when the slides are in the obstructions pass position that cause the slides to shift slightly in the housing slots as the plunger is tugged by the lock picker.

10. A tamper resistant combination lock as defined in claim 9, wherein said second plurality of slides are each reversible in the housing slots to effect three passing positions of the slides with only two standard slides.

11. A tamper resistant combination lock as defined in claim 9, including means providing a snap action as the slides move relative to the plunger obstructions from one of three positions to another wherein the blocking apertures in the slides are defined by slots extending transversely from the passing apertures, said slides each having two recesses therein that receive a portion of the plunger obstructions in the two blocking positions that provide the snap action movement of the slides as they are moved between the plunger blocking and passing positions.

12. A tamper resistant combination lock as defined in claims 1 or 9, including means for adapting the lock to be retrofitted to a zipper case including means to fasten the housing adjacent the end of the zipper, a slot in the housing receiving the zipper tang with the plunger projecting through the zipper tang.

13. A tamper resistant combination lock for a container, comprising; a lock housing having a main passage there-through intersected by a plurality of cross slots, a plunger slidable in the main passage having a plurality of obstructions therein, a plurality of blocking slides reciprocal in the cross slots movable to at least three positions relative to the plunger, two in which the slides block the plunger obstructions and one in which the slides do not block the plunger obstructions, said slides being standardized including a first plurality of slides having a central aperture there-through permitting the passage of the obstructions there-through and side apertures there-through that block the obstructions and a second plurality of slides having a side aperture there-through permitting the passage of the obstructions there-through and a central aperture and a side aperture there-through that block the plunger obstructions, whereby the possible lock combinations are increased, including means to minimize lock picking including means in the slides engageable with the plunger obstructions when the slides are in the obstructions pass position that cause the slides to shift slightly in the housing slots as the plunger is tugged by the lock picker, the slides having apertures there-through that define the plunger obstructions pass position, at least one flexible finger in the slide apertures engageable with the obstructions when the slides are in the plunger obstructions pass position defining the means to minimize lock picking.

14. A tamper resistant combination lock for a container, comprising; a lock housing having a main passage there-through intersected by a plurality of cross slots, a plunger slidable in the main passage having a plurality of obstructions therein, a plurality of blocking slides reciprocal in the cross slots movable to at least two indexible positions relative to the plunger, one in which the plunger obstructions are blocked, and one in which the plunger obstructions may pass, said indexible positions being defined by cooperating means on the slides and the plunger obstructions that provide a snap action movement as the slides are moved from one indexible position to the next, said plunger being movable in a direction perpendicular to the planar slides, said cooperating means including spheroidal surfaces in the plunger obstructions receivable in at least two spheroidal recesses in the slides aperture that cause the slides to have snap action movement as the spheroidal surface obstructions move from one spheroidal recess to another.

* * * * *